US006691619B2

(12) United States Patent
Saito et al.

(10) Patent No.: US 6,691,619 B2
(45) Date of Patent: Feb. 17, 2004

(54) APPARATUS FOR AUTOMATING SWITCHING OPERATIONS OF A WEB OFFSET PRINTING PRESS

(75) Inventors: Kazunori Saito, Chiba (JP); Hiroyuki Nagano, Noda (JP)

(73) Assignee: Komori Corporation, Tokyo (JP)

( * ) Notice: Subject to any disclaimer, the term of this patent is extended or adjusted under 35 U.S.C. 154(b) by 1 day.

(21) Appl. No.: 09/852,687

(22) Filed: May 11, 2001

(65) Prior Publication Data

US 2002/0002918 A1 Jan. 10, 2002

(30) Foreign Application Priority Data

May 17, 2000 (JP) ..... 2000-144890

(51) Int. Cl.[7] ..... B41F 1/46
(52) U.S. Cl. ..... 101/477
(58) Field of Search ..... 101/216, 477, 101/479; 270/1.01, 20.1, 21.1

(56) References Cited

U.S. PATENT DOCUMENTS 5,699,735 A 12/1997 Stein et al. ..... 101/219
5,983,793 A * 11/1999 Volz et al. ..... 101/216
6,006,662 A * 12/1999 Ishida et al. ..... 101/141
2002/0005129 A1 * 1/2002 Nagano et al. ..... 101/382.1

FOREIGN PATENT DOCUMENTS

EP 0533307 A 3/1993
EP 0710558 A 5/1996
EP 0983852 A 3/2000
JP 2000-130538 A * 5/2000 ..... F16H/25/14

* cited by examiner

*Primary Examiner*—Stephen D. Meier
*Assistant Examiner*—Blaise Mouttet
(74) *Attorney, Agent, or Firm*—Birch, Stewart, Kolasch & Birch, LLP

(57) ABSTRACT

A web offset printing press has a single switch for automatically changing a previous printing to next printing in order to actuate web continuous supplement means 100, printing plate changing means 207, 208, folding device status switching means, and an ink supplement means 800 along predetermined steps in accordance with a signal from said switch when switching from a previous job to a next job.

5 Claims, 11 Drawing Sheets

APPARATUS FOR AUTOMATING SWITCHING OPERATIONS OF A WEB OFFSET PRINTING PRESS

The entire disclosure of Japanese Patent Application No. 2000-144890 filed on May 17, 2000 including specification, claims, drawings and summary is incorporated herein by reference in its entirely.

BACKGROUND OF THE INVENTION

1. Field of the Invention

The invention relates to an apparatus for automating switching operations for a web offset printing press, and particularly to an apparatus for automatically actuating each devices successively by an operator pushing a single button.

2. Description of Related Art

In a conventional art, when changing from a previous job to a next job in a web offset printing press, an operator has to operate each device to activate the device in order. This takes a lot of time and burdensome to the operator.

For example, when the previous job is finished, printing units are stopped to clean a blanket cylinder with a blanket. Then, printing plates are exchanged, and further, an old web roll is changed to a new web roll. In order to prepare for the next job, various presetting operations, such as an adjustment of an open degree of an ink fountain key in accordance with a picture pattern of a new printing press, a control of a rotational amount of each ink fountain roll, a determination of an amount of supplying dampening water, and a setting of a folding machine.

In the above described conventional art, when changing from the previous job to the next job, an operator has to activate each device in order. Thus, it takes a long time and a heavy burden is imposed on the operator.

In the present invention, an operator merely has to push a single button to automatically operate each device to solve the above problems can be resolved.

SUMMARY OF THE INVENTION

To accomplish the above object, an apparatus for automating switching operations of a web offset printing press according to the present invention comprises web continuous supplement means for attaching a web of a new web roll to a web of an old web roll to supply the web successively, printing plate changing means for changing a printing plate supported on a plate cylinder, folding device status switching means for switching a folding device status in accordance with a folding condition of the next printing, and ink supplement means for reducing ink amount to a basic ink layer thickness distribution and overlapping an ink layer distribution, corresponding to the next printing, on the basic ink layer thickness distribution. A single switch for changing a previous printing to the next printing in order to actuate each means along predetermined steps in accordance with a signal from the switch.

BRIEF DESCRIPTION OF THE DRAWINGS

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

DETAILED DESCRIPTION OF THE PREFERRED EMBODIMENT

Figure 1:
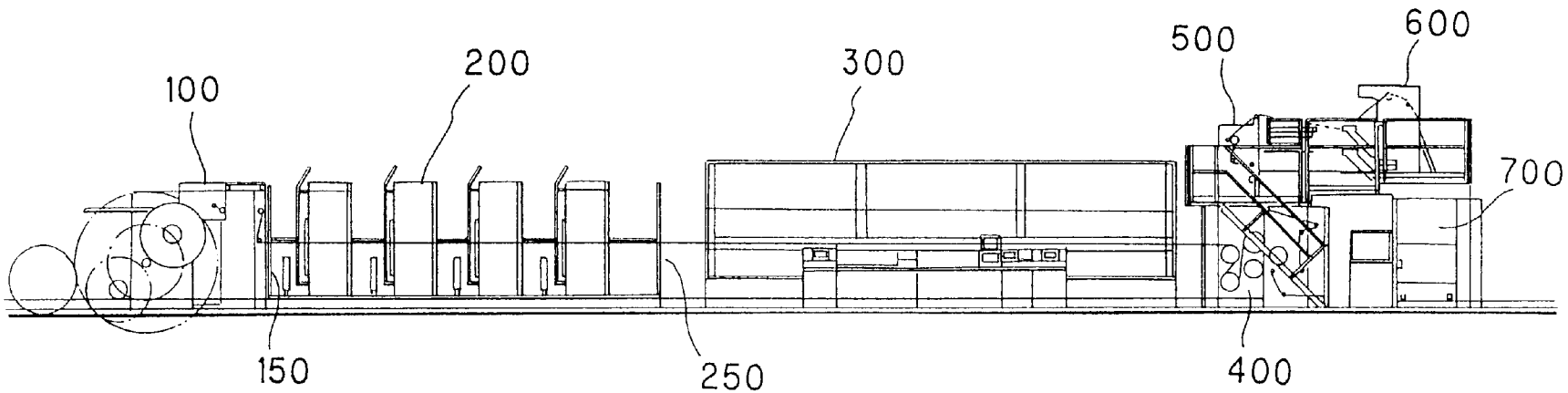
FIG. 1 shows the entire schematic view of a offset rotary printing press of an embodiment according to the present invention.

A preferred embodiment of a web offset printing press according to the present invention is as shown in FIG. 1.

In the web offset printing press as shown in FIG. 1, a previous job can be automatically switched to a next job, by an operator pushing a single button, by continuously activating each device. The web offset printing press comprises a sheet supply device 100, a plurality of printing units 200, a drying device 300, a cooling device 400, a web passing device 500, a drag device 600, a folding device 700 and so on.

Figure 2:
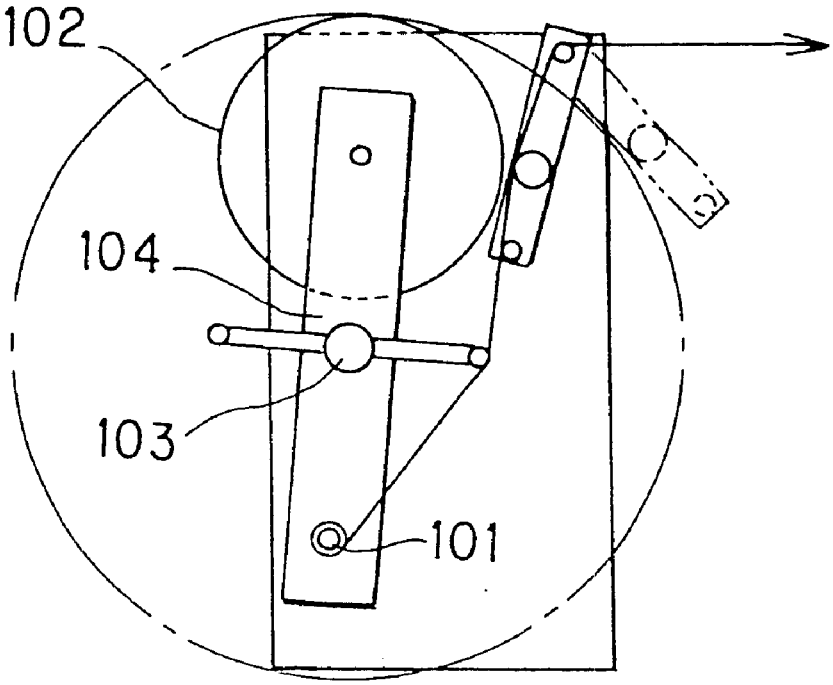
FIG. 2 shows a sheet supply device.

In the sheet supply device as shown in FIG. 2, two web rolls 101 and 102, each wound in a roll form, are attached to the both ends of a turret arm 104, respectively, and the turret arm 104 is pivotally mounted such that the arm 104 is rotatable about a central axis 103. When a web 10 (printing sheet) is rolled out from a web roll 101 and becomes close to an end, a web from the next web roll 102 is jointed at the rear end portion of the web 10 to supply the web to the printing units 200.

Figure 3:
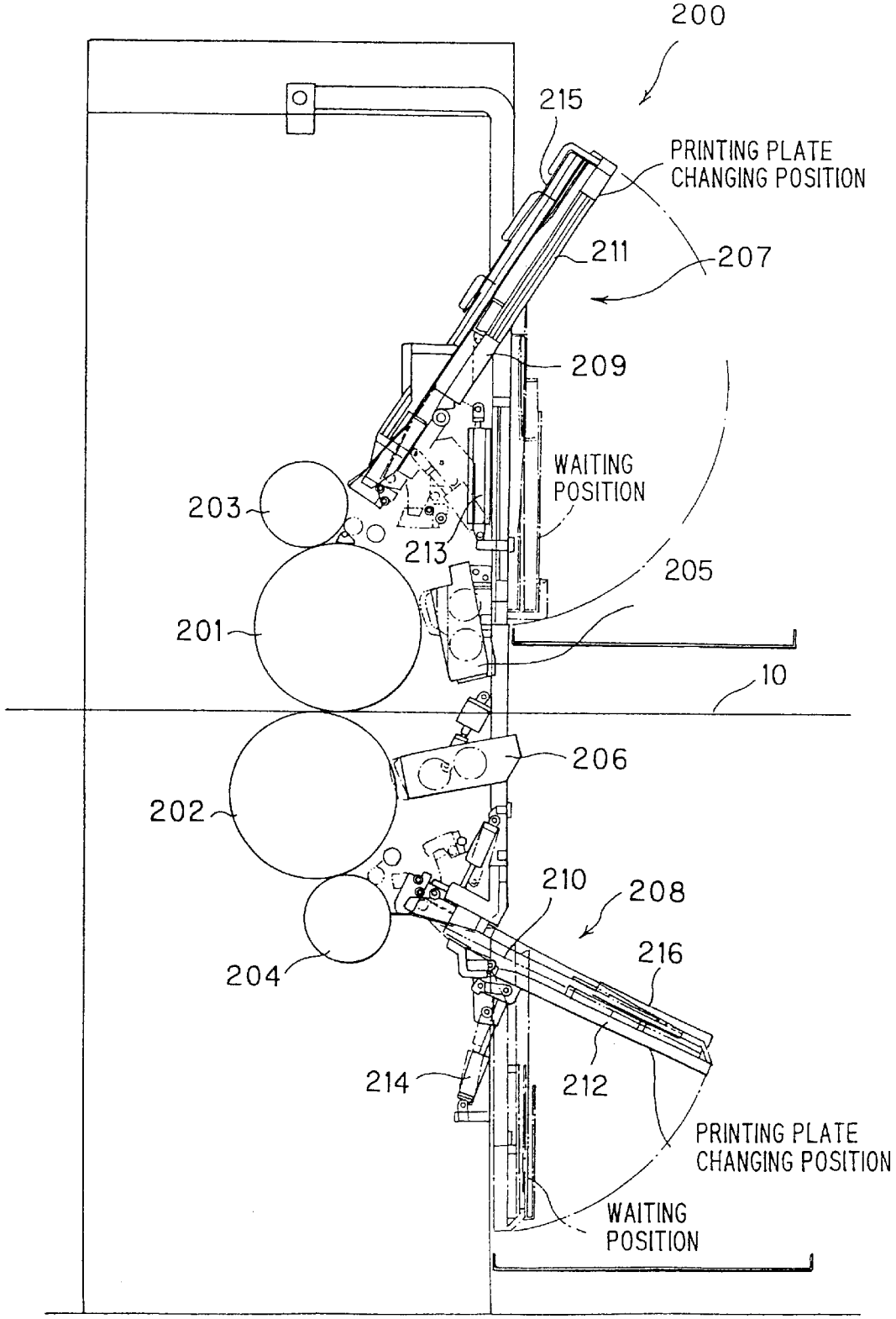
FIG. 3 is a cross sectional view of a printing unit.

In each printing unit 200 as shown in FIG. 3, blanket cylinders 201, 202 and printing cylinders 203, 204 are arranged symmetrically with respect to a horizontal web traveling path. A blanket cleaning device 205 (206) is provided at each blanket cylinder 201 (202) and an automatic printing plate changer (APC) 207 (208) is provided at the printing cylinder 203 (204).

The upper automatic printing plate changer 207 provides a guide frame 211 rotatable about a supporting axis 209, and an activator 213 shifts the guide frame 211 from a stand by position to a printing plate changing position as shown in a dotted line. At the guide frame 211, a holder 215 for holding an old printing plate or a new printing plate is provided.

After shifting the guide frame 211 to the printing plate changing position, the old printing plate is disengaged from the printing cylinder 203. By backwardly rotating the printing plate 203, the old printing plate is guided along the guide frame 211 so that the old printing plate can be picked up by extending/shrinking an actuator (not shown). Then, the new printing plate is supplied to a printing cylinder 203 along the guide frame 211. By forwardly rotating the printing plate 203, the new printing plate is attached to the printing cylinder 203.

Similarly, a lower automatic printing plate changing device 208 provides a guide frame 212 rotatable about a supporting axis 210, and an activator 214 shifts the guide frame 212 from a stand by position to a printing plate changing position along a dotted line as shown in the drawing. A holder 216 for holding the old printing plate or the new printing plate is provided at the guide frame 212.

After shifting the guide frame 212 to the printing plate changing position, the old printing plate is disengaged from the printing cylinder 204. By backwardly rotating the printing cylinder 204, the old printing plate is lowered along the guide frame 211.

Then, the new printing plate is supplied to the printing cylinder 204 along the guide frame 212. By forwardly rotating the printing cylinder 204, the new printing plate is attached to the printing cylinder 204.

Figure 4:
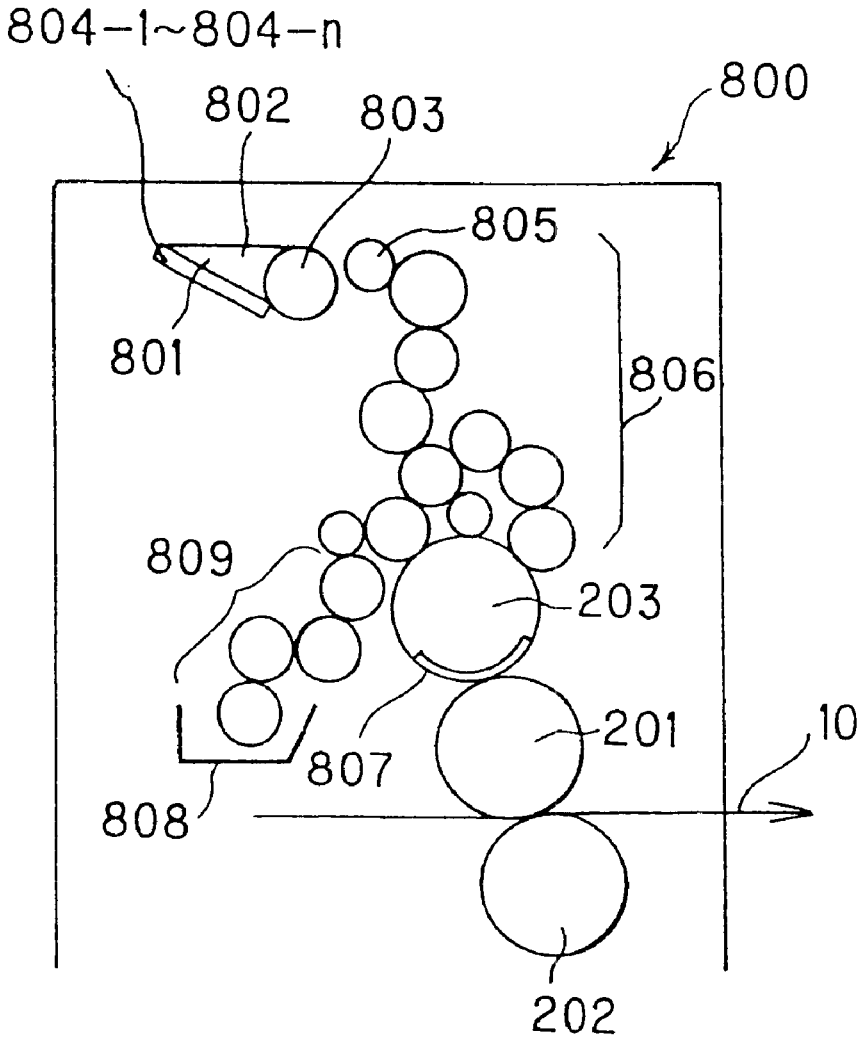
FIG. 4 shows an ink supply device.

Regarding the printing plate mounted on the printing cylinder 203 (204), an ink supplement device 800 is provided as shown in FIG. 4.

The ink supply device 800 supplies ink 802 in an ink fountain 801 on an ink fountain roller 803 by adjusting an open degree of each ink fountains keys 804-1, 801-2, . . . 801-n in accordance with FIG. 4. Ink supplied on the ink fountain roller 803 is transferred to a printing plate 807 through a group 806 of ink rollers by operating an ink ductor roller 805. Simultaneously with such an ink supply operation, dampening water in a water tank 808 is supplied to the printing plate 807 through a group of dampening rollers 809.

In the ink supply device 800, when changing the old printing plate 807 to a new printing plate, printing data such as an open degree of the each ink fountain keys 804-1, 804-2, . . . 804-n corresponding to a picture pattern of the new printing plate, a rotational amount of the ink fountain roller 803, and a supply amount of dampening water in the water tank 808 is preset as described below. The blanket cleaning device 205 (206) removes foreign matter such as remained ink and so on by contacting a brush or cloth with the blanket cylinder 201 (202).

A drying machine 300 is a device for heating and drying a printed web 10 fed through the printing units 200.

A cooling device 400 is a device for cooling the web 10 passed through the drying machine 300.

A web path device 500 is a device for adjusting a passing direction to control a position of a web and its tensile force.

A folding device 700 is a device for cutting the web after dry and cool operations and folds each piece of the web 10.

There are a number of types of folding devices based on combinations of cutting and folding the web, such as folding along a central line of the web with respect to a width direction, it is so-called as "former fold", cutting a web having a predetermined length by a cut-off cylinder, folding a cut-off sheet by a folding cylinder along a width direction or a longitudinal direction, it is so called as "parallel fold", and half folding parallel folded sheets by a chopper along an orthogonal direction.

An infeed dancer device 150 is provided between the sheet supply device 100 and the printing units 200, and a final unit dancer device 250 is provided between the printing units 200 and the drying machine 300.

The dancer device 150 (250) winds a web among three rollers, and by removing a central roller in a vertical direction, removes slackness in the web caused by rotation of the printing units 200 in forward/backward directions.

These devices 200 through 700 are connected by a driving axis and driven by a main motor (not shown) mounted at the printing units 200. The main motor can be disconnected from the driving axis by operating a driving clutch provided between the printing units 200 and the final unit dancer 250.

Figure 5:
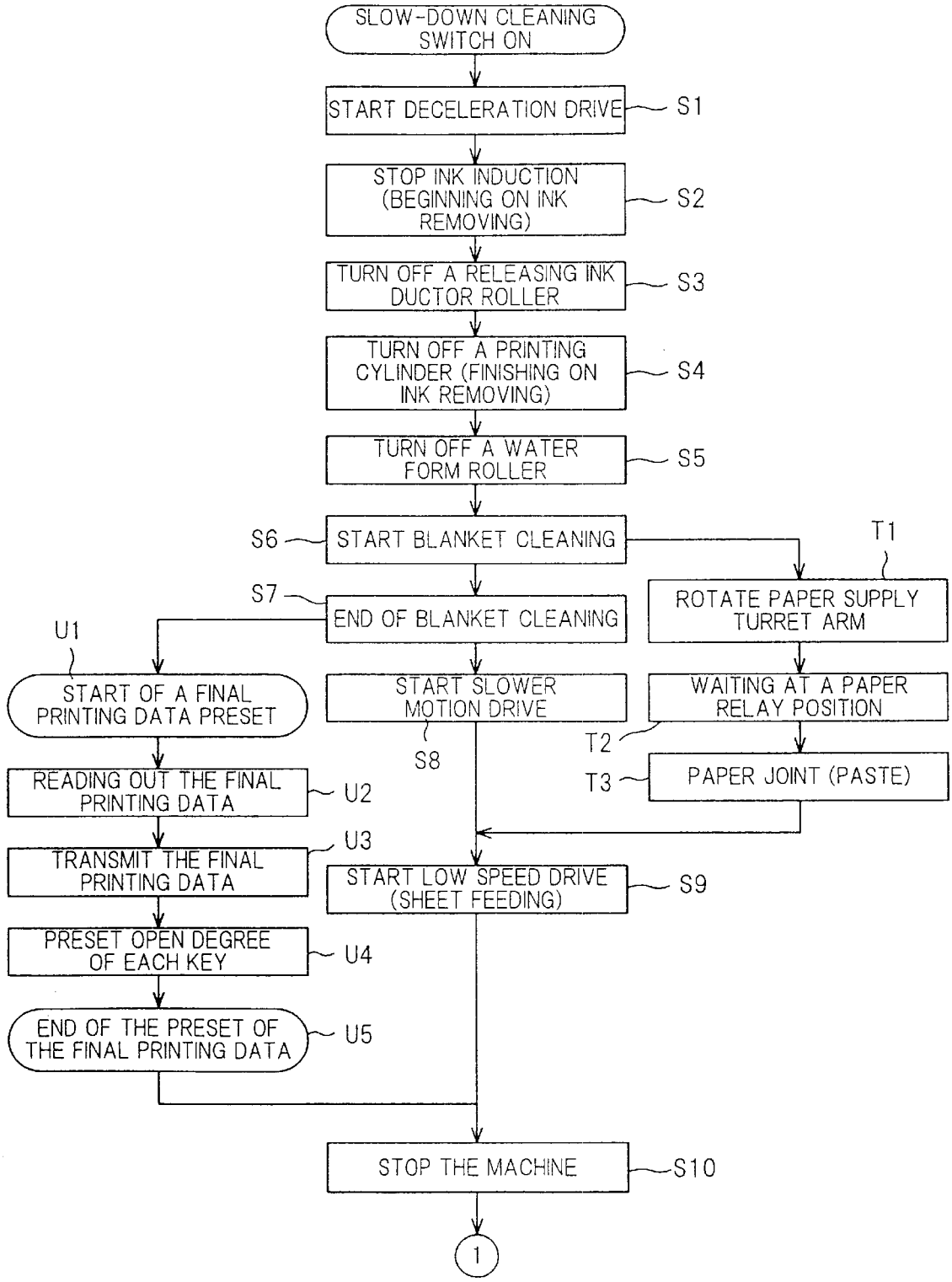
FIG. 5 is a flow-chart showing a plurality of steps executed by pushing on a deceleration cleaning switch.
Figure 6:
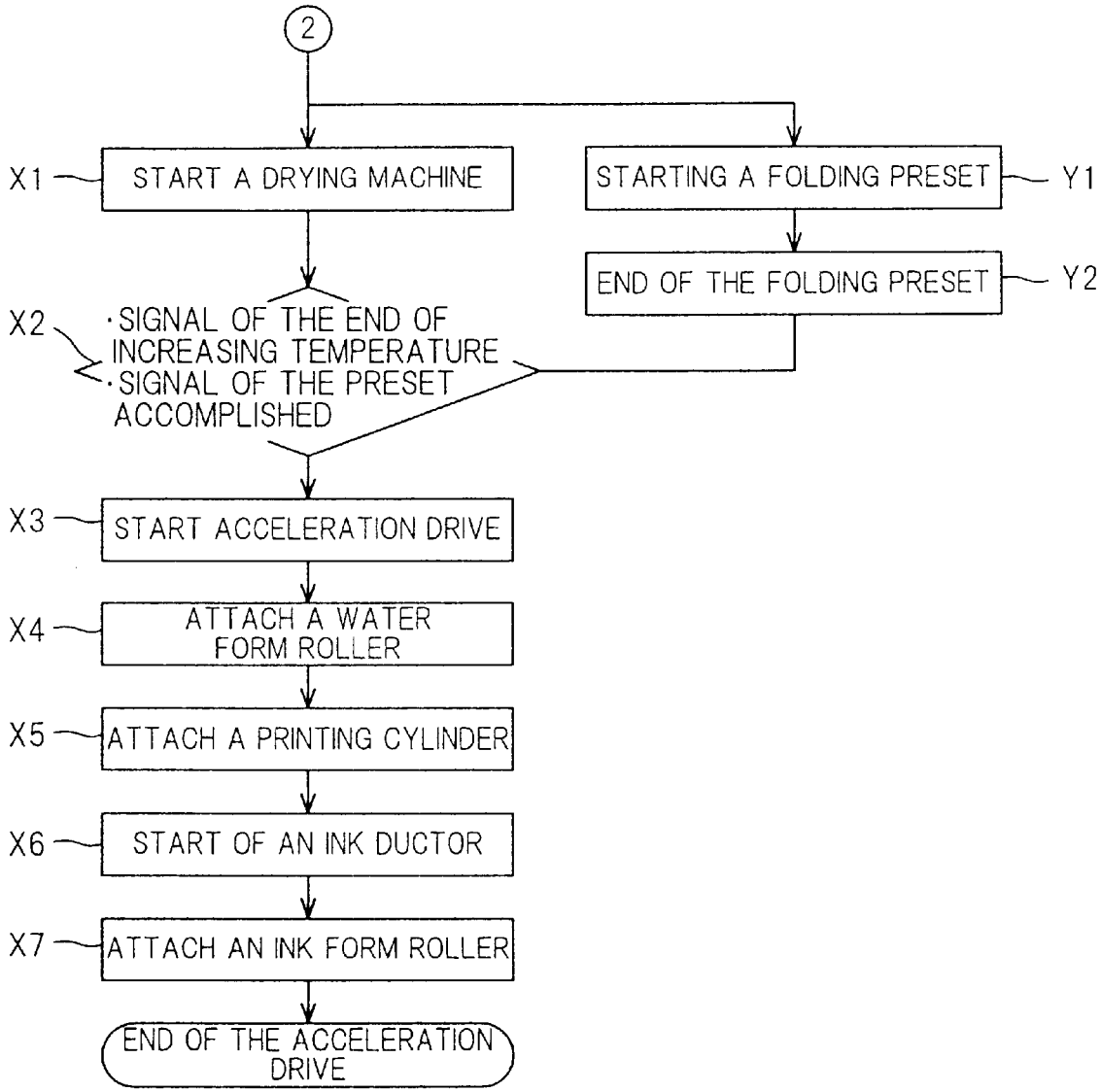
FIG. 6 is another flow-chart showing a plurality of steps executed by pushing the deceleration cleaning switch.
Figure 9:
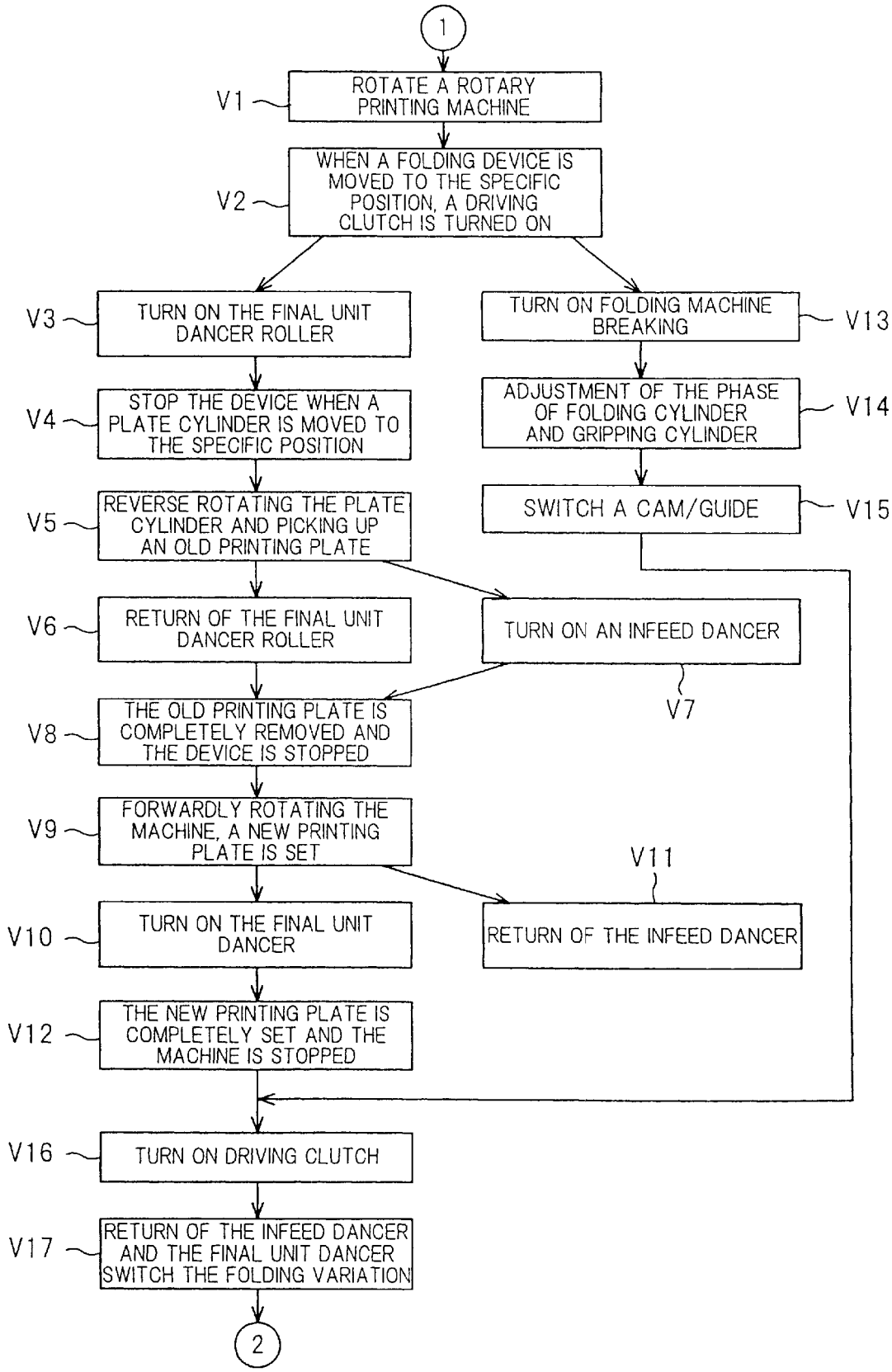
FIG. 9 is another flow-chart showing a plurality of steps executed by pushing the deceleration cleaning switch.

In the offset rotary printing press constructed as described above, an automatic device that executes, upon changing a printing job, an adjustment of an ink layer thickness, an exchange of web rolls, an exchange of printing plates, and a selection of a folding method as shown in FIGS. 5, 6, and 9, is provided. A web speed, when the automatic device is being activated, is shown in FIG. 7.

By turning on a reduced-speed cleaning switch, the following plurality of steps are continuously and simultaneously executed under an automatic control as shown in FIG. 5.

Figure 7:
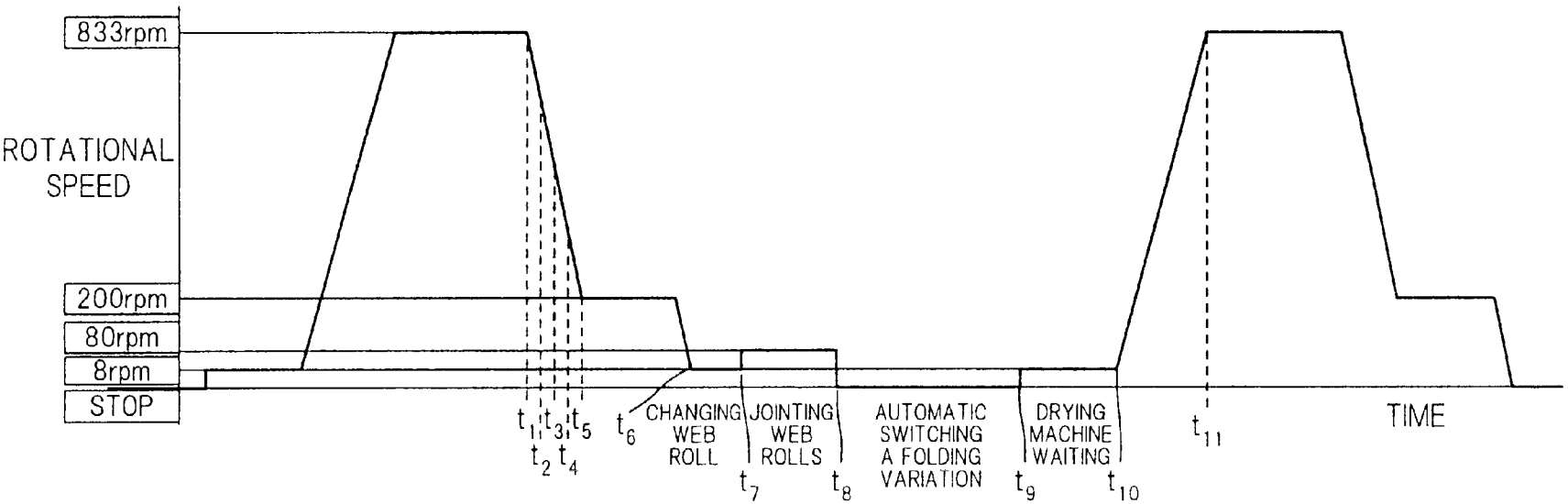
FIG. 7 is a time-chart indicating a feeding speed of the web.

When the previous job is finished, an operator turns on the reduced-speed cleaning switch, to switch the job, at a timing t1, as shown in FIG. 7, to start slowing down of the web (step S1).

When a rotational speed of the printing cylinders 203 (204) becomes S1 at a timing t2 as shown in FIG. 7, an ink ductor roller 805 is stopped to shut-down ink supplement to the group of ink rollers 806 (step S2). While continuing the printing operation in a decelerating mode, ink removing is conducted, ink on the group of ink rollers 806 is consumed, and gradually reduce a thickness of the ink layer.

When the rotational speed of the plate cylinders 203 (204) becomes S2 at a timing t3, an ink form roller is released (step S3). Simultaneously, rotation of the blanket cylinder 201 (202), as a printing cylinder, and plate cylinders 203 (204) are turned off (S4). The ink removing starts at the timing t2 and finishes at a timing t3.

Figure 8:
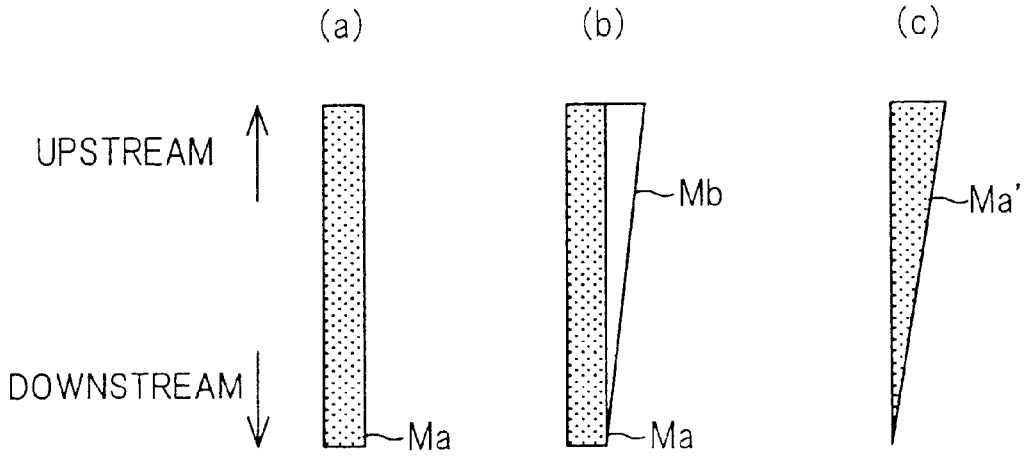
FIG. 8 shows an ink layer thickness.

As shown in FIG. 8, in the ink removing operation, an ink layer thickness distribution Mb corresponding to a printed pattern of the old picture plate, which is formed on the group of ink rollers 806, is removed at the timing t2. At the timing t3, a minimum ink layer thickness distribution Ma' required for actual printing that becomes thinner along a direction from an upper stream to a lower stream remains.

In FIG. 8, Ma indicates the minimum ink layer thickness required during printing and Mb indicates a condition in which a new ink layer is overlapped on the minimum ink layer Ma.

Then, at a timing t4 as shown in FIG. 7, a water form roller in the group 809 of ink rollers 809 is released (S5). An ink layer thickness distribution on the group of the ink rollers 806 becomes flat by the rotation of the group of the rollers 806 at the timing t3. Thus, the distribution becomes the minimum ink layer thickness distribution Ma, required for printing, as shown in FIG. 8(*a*).

As the result, the ink layer thickness distribution on the group of the ink rollers 806 becomes the minimum ink layer thickness distribution Ma. Therefore, a new printing job is not influenced by a picture pattern of the previous printing job. As described below, when a print pattern of the next printing job is preset, an ink layer thickness distribution can be quickly changed to a distribution corresponding to a printing pattern of the next job.

When the rotational speed of the web is decelerated to 200 rpm, the blanket cylinder 201 (202) is cleaned by a blanket cleaning device 205 (206) at a timing t5 as shown in FIG. 7.

After finishing the blanket cleaning (S7), the web begins slower motion driving at a speed of about 8 rpm at a timing t6 as shown in FIG. 7 (step S8).

On the other hand, at the same time as initiation of the blanket cleaning, the turret arm 104 of the sheet supply device 100 is rotated (step T1). Then, the new web roll 102 is placed at a predetermined relay position (step T2). Further, after starting the above slower motion drive, a sheet relay of the old web roll 101 to the new web roll 102 is executed (T3).

Thus, while the blanket cleaning is being operated in the printing units 200, the sheet relay is executed in the sheet supply device 100 so that a total operation time can be shortened.

After finishing the sheet relay, a reduced-speed rotation of the web at about 200 rpm is started at a timing t7 as shown in FIG. 7 (step S9).

Since the reduced-speed rotation is faster than the above slower motion drive, a portion for joining an old sheet and a new sheet can be quickly fed and discharged from the folding device 700.

During the blanket cleaning (step S7) and the low-speed rotation (step S9), data for presetting final printing is simultaneously preset (step U1).

The data for final printing such as an open degree of the each ink fountain keys 804-1, . . . 804-n, a rotational amount of an ink fountain roller 803, and a supply amount of dampening water 808 is read out from a data base of a computer (not shown) (step U2). The read out data for the final printing is transmitted to an ink supply device 800 (U3) to preset the data for final printing including the open degree of the each ink fountain keys in a control device of the ink supply device 800 (step U4).

The preset of the data for final printing must be conducted for each of the upper and lower ink supply devices 800. In the case of a multi-color double-sided printing, the presetting is necessary eight times because the preset must be conducted for each color.

As described above, while a hardware treatment with respect to each device 100 through 700 are conducted, a software treatment such as the preset of the final printing data is simultaneously conducted to shorten the total operation time.

As long as the preset of the final printing data is started after finishing the blanket cleaning (step S7) and finished before accomplishing the automatic printing plate exchange as described below, it need not be finished before the device stops (step S10).

As shown in FIG. 9, an exchange of automatic printing plates and a selection of folding device status are simultaneously operated.

Namely, the rotary printing press is driven (step V1). When the folding cylinder of the folding machine 700 moves to a specific position, the driving clutch is turned off (step V2).

The reason for turning off the clutch is to avoid occurrence of troubles caused by reverse rotation of the folding machine 700.

As described below, if a web is fed in a reverse direction in order to automatically exchange printing plates in the printing units 200, a folded sheet is released from a jaw cylinder and a folding cylinder in the folding device 700 for cutting and folding.

Next, the final unit dancer 250 is turned on (V3) so that a tensile force on a web fed from the printing units 200 to the drying device 300 is prevented from becoming loose by wounding the web around a roller moving in a up-down directions.

Then, when the plate cylinder 203 (204) is moved to a specific position for exchanging the printing plate, the device (the printing units 200 only) is stopped (step V4). The plate cylinders 203 (204) is rotated in the reverse direction, the old printing plate is removed from the plate cylinder 203 (204) by the automatic printing plate exchanger 207 (208) (step V5).

By rotating the plate cylinder 203 (204) in a reverse direction, a roller of the final unit dancer 250 is returned to the original position (step V6). At the same time, the infeed dancer device 150 is turned on (step V7) in order to avoid the web fed from the printing units 200 to the sheet supply device 100 from loosening.

Thereafter, after finishing removal of the old printing plate, the machine (the printing units 200 only) is stopped (step V8).

Then, the machine (the printing units 200 only) is rotated in the forward direction, the new printing plate is supplied from the automatic printing plate exchanger 207 (208) and attached to the plate cylinder 203 (203) (step V9).

Further, the final unit dancer 250 is turned on (step V10) to prevent the tensile force on the web, fed from the printing units 200 to the drying machine 300, from becoming loose. Simultaneously, the roller of the infeed dancer device 150 is returned to the original position (step V11).

When setting of the new printing plate on the plate cylinder 203 (204) has completed, the machine (the printing units 200 only) is stopped (step V12).

After turning off the driving clutch, a brake of the folding machine is turned on (step V13) to change folding device status simultaneously.

The folding device status is changed by adjusting a phase of the folding cylinder and the gripping cylinder (step V14) and a selection of a cam/guide member (step V15).

An adjustment of the phase of the folding cylinder and the gripping cylinder means to change the phase of a gripping board of the gripping cylinder with respect to a needle and a knife of the folding cylinder corresponding to a single parallel fold or a double parallel fold. For example, as shown in Japanese Patent Publication Kokai 63-282053, the adjustment is made by a gear transmission mechanism.

Switching of the cam/guide member includes cam switching for changing a phase of a cam mechanism for switching an operation timing of a gripping claw, knife, needle and so on provided at a cutting cylinder, a folding cylinder and a gripping cylinder and a guide switching mechanism for changing the single parallel fold, the double parallel fold, and a delta fold.

Figure 10:
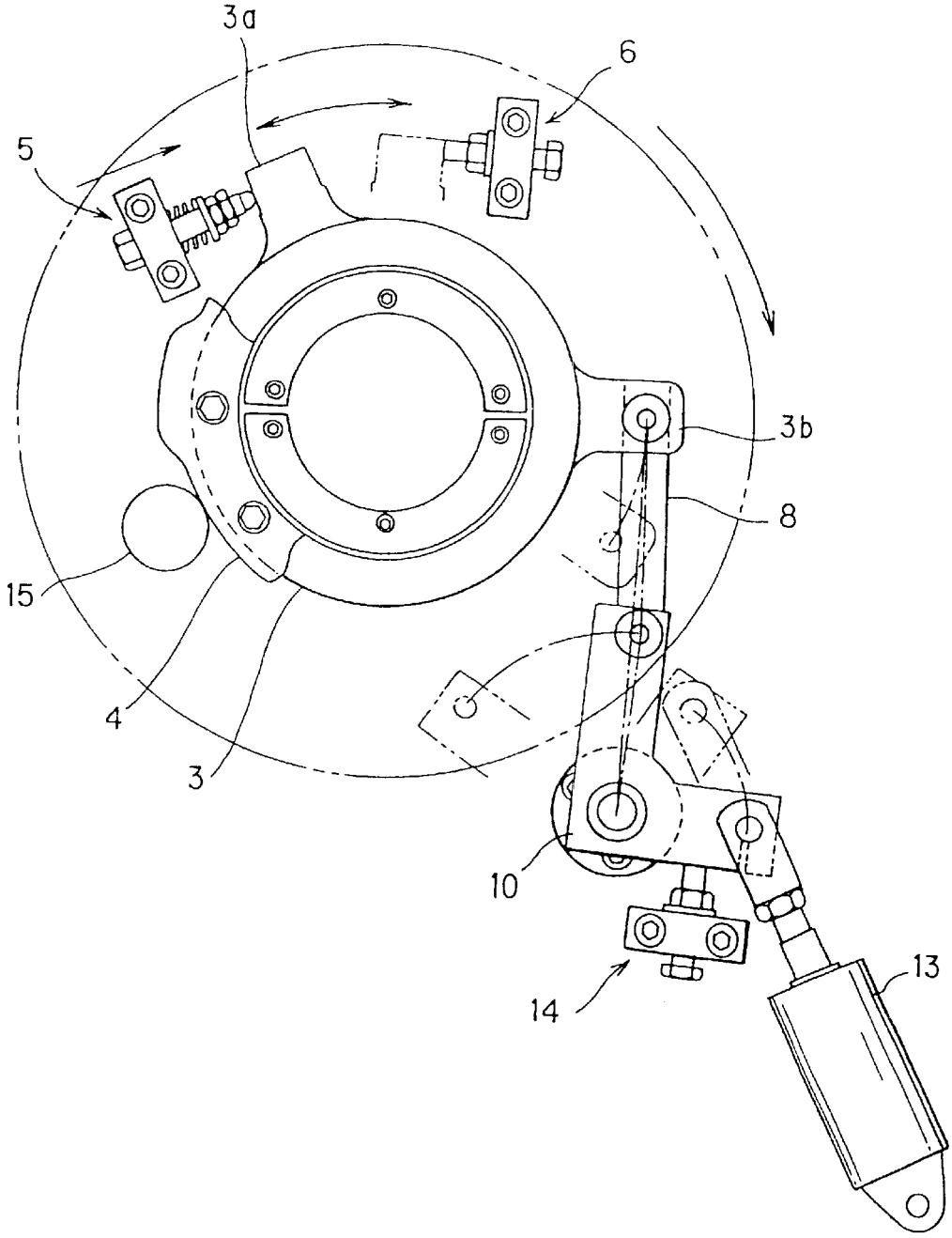
FIG. 10 shows a cam switching operation.

As shown in FIG. 10, a cam switching mechanism comprises a cam holder 3 rotatably supported and having, on an outer peripheral portion thereof, protrusions 3*a*, 3*b*, a circular cam 4 attached to the cam holder 3 and having a predetermined outer peripheral shape, a cam follower 15 that rolls on the outer peripheral surface of the cam 4, a link plate 8 connected to the protrusion 3*b* of the cam holder 3 and extends and retracts to rotate the cam holder 3, a lever 10, an air cylinder 13, a first stopper 6 for restricting rotation of the cam 4 in one rotating direction caused by the extension of the air cylinder 13, a second stopper 14 for restricting rotation of the cam 4 in the opposite rotating direction caused by the retraction of the air cylinder 13, and a third stopper 5 for urging the protrusion 3*a* of the cam holder 3, restricted from rotating in the opposite direction by the second stopper 14, in the one rotating direction restricted by the second stopper 14. The detailed description of the embodiment is described in Japanese Patent Publication No. 2000-130538 published on May 12, 2000 based on Japanese Patent Application Hei10-301983 filed on Oct. 23, 1988.

Figure 11:
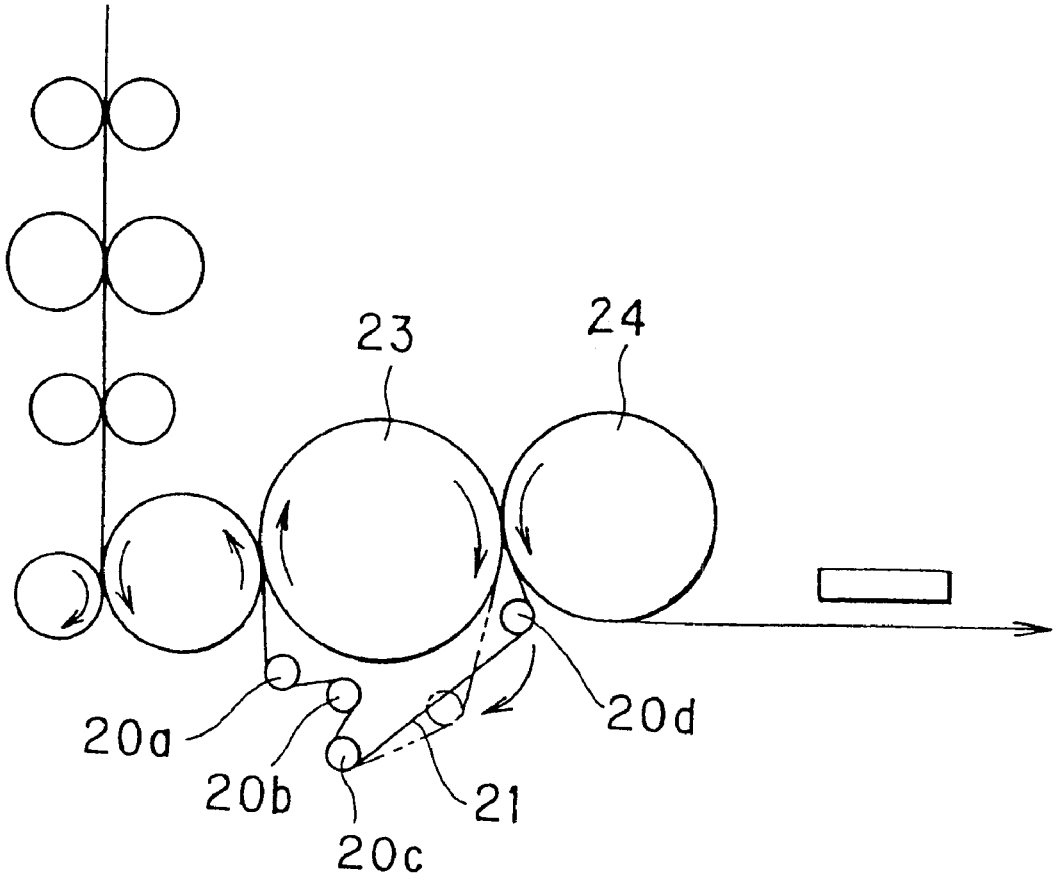
FIG. 11 shows a guide switching operation.

As the guide switching member, there is an embodiment as shown in FIG. 11.

The device, as shown in FIG. 11, is a parallel folding device having a first gripping cylinder 23 and a second gripping cylinder 24, the peripheral surfaces of which are in contact with each other. A belt 21 is wound on the first gripping cylinder 23 and rollers 20*a* through 20*d* arranged parallel to the first gripping cylinder 23. The detailed description of the embodiment is described in PCT application (PCT/JP00/01597 filed on Mar. 16, 2000) based on Japanese Patent Application No. 10-266166 filed on Sep. 21, 1998.

In the case where a single parallel fold is operated in the device, the roller 20*d* is moved along a solid line in FIG. 11 and the belt 21 is moved to a guiding position.

At the guiding position of the belt 21, a sheet is changed from the first gripping cylinder 23 to the second gripping cylinder 24 to parallel-fold the sheet once. If double parallel fold or delta folding is operated, the roller 20*d* is moved toward an arrow along a dotted line in FIG. 11 and the belt 21 is shifted to a shelter position.

At the shelter position of the belt 21, the double parallel fold or the delta folding is operated when the sheet is passed from the first gripping cylinder 23 to the second gripping cylinder 24.

Upon finishing the above exchange of the printing plates and the selection of folding device status, the driving clutch is turned on (step V16), and the dancer device 150, 250 is returned to the original position (step V17).

In order to prepare for the next job, the steps shown in FIG. 6 are continuously executed.

At a timing t9 as shown in FIG. 7, the machine is rotated at a reduced-speed of about 8 rpm. A stand by operation of the drying machine 300 is started (step X1). Simultaneously, a folding preset is started (step Y1).

The folding preset means to control a position of each control axes of the folding machine 700 in accordance with the next job, and includes setting of a former, a chopper, and so on based on the width, quality, and thickness of a sheet and its folding device status.

Further, when a completion signal of increasing a temperature of the drying machine 700 and a completion signal of presetting the folding machine are input (step X2), the feeding speed of the web is accelerated (step X3).

After the rotational speed is accelerated to a predetermined speed, the water supply roller 809 is attached to supply the dampening water in the water tank 808 (step X4) and the blanket cylinders 201 (202), as a printing plate cylinder, and the plate cylinder 203 (204) are attached (step X5). Dampening operation of the ink ductor roller 805 is started to operate pre-inking (step X6).

In the pre-inking, the open degree of the each ink fountain keys 804-1, . . . 804-n corresponding to the picture pattern of the new printing plate, the rotational amount of the ink fountain roller 803, and the supply amount of the dampening water in the water tank 808 are controlled in accordance with the final printing data preset in the ink supply device 800 with respect to the new job. Regarding the minimum ink layer thickness Ma, required for printing, remaining at the group of ink rollers 806 (FIG. 8(*a*)), the ink layer thickness distribution Mb, corresponding to the picture pattern of the new printing plate, is overlapped thereon (FIG. 8(*b*)).

After finishing the pre-inking, the group of the ink rollers 806 are attached (step X7). When the printing speed is accelerated to the predetermined speed, the acceleration of the rotational speed is finished.

As described above, in the above embodiment according to the present invention, when switching the previous job to the new job, each devices 100 through 800 are automatically operated by an operator's operation of a single button so that the total operation time can be shortened and the operator's burden can be reduced.

That is, by actuating the single deceleration cleaning switch, ink removing, blanket cleaning, exchanging/paper-connecting of web rolls, a final printing data preset, the automatic exchange of printing plates, a selection of automatic folding device status, a stand by operation of the drying machine 300, and a folding preset can be operated.

Further, the blanket cleaning, the exchanging/paper-connecting of the web roll, and the final printing data preset can be simultaneously executed. The automatic exchange of printing plates and the selection of the automatic folding device status can be simultaneously executed. The stand by operation of the drying machine 300 and the folding preset can be executed simultaneously. Therefore, the total operation time can be reduced.

As described above with reference to the embodiment of the present invention, in an apparatus according to the present invention for automating switching operations for an offset rotary printing press, the previous job is automatically changed to the new job by pushing a single button. In order to change the previous job to the next job automatically, each device is continuously actuated so that the total operation time can be shortened and the operator's burden can be reduced.

The present invention is, of course, in no way restricted to the specific disclosure of the specification and drawings, but also encompasses any modifications within the scope of the appended claims.

What is claimed is:

1. An apparatus for automating switching operations of a web offset printing press, comprising;

web continuous supplement means for connecting a web of a new web roll with a web of an old web roll to supply the web successively;

printing plate changing means for changing a printing plate supported on a plate cylinder;

folding device status switching means for switching a folding device status of a folding machine in accordance with a folding condition of a next printing;

ink supplement means for reducing ink amount to a basic ink layer thickness distribution and overlapping an ink layer distribution corresponding to the next printing on the basic ink layer thickness distribution;

a single switch operable by an operator for changing a previous printing to the next printing, said switch actuating each of said means in accordance with predetermined operational steps based on a signal from said switch, wherein at least two of said means including the printing plate changing means and the folding device status switching means are actuated in parallel upon operator actuation of said switch so as to provide mutually overlapping operational steps;

an infeed dancer device provided between a sheet supply device and printing units of the printing press for removing slackness in the web caused by the printing units when rotated in the backward direction;

a final unit dancer device provided between the printing units and the folding machine for removing slackness in the web caused by rotation of the printing units in the forward direction; and wherein the infeed dancer device and the final unit dancer device are simultaneously operated when the printing plate changing means and the folding device status switching means are operated in parallel upon actuation of said switch.

2. An apparatus for automating switch operations of a web offset printing press as claimed in claim 1, wherein an ink layer thickness is reduced to a basic ink layer thickness distribution by said ink supplement means, a web of said new web roll is connected with a web of said old web roll by said web continuous supplement means to supply a web successively, a printing plate supported on a plate cylinder is changed by said printing plate change means, a folding condition of said folding device is selected by said folding device status switching means in accordance with a folding condition of the next printing, and an ink layer thickness distribution corresponding to the next printing is overlapped on said basic ink layer thickness distribution by said ink supplement means.

3. An apparatus for automating switch operations of a web offset printing press as claimed in claim 1, and additionally comprising blanket cleaning means, wherein a blanket cylinder of said offset printing press is cleaned by said blanket cleaning means while connecting said web of said new web roll with said web of said old web roll by said web continuous supplement means to supply a web successively after the ink amount is reduced to said basic ink layer thickness distribution by said ink supplement means.

4. An apparatus for automating switch operations of a web offset printing press as claimed in claim 3, wherein said blanket cylinder is cleaned by said blanket cleaning means while data for overlapping an ink layer thickness distribution corresponding to the next printing job on said basic ink layer thickness distribution by said ink supplement means is read out from a data base and said data is preset as data for the next printing.

5. An apparatus as claimed in claim 3 wherein said at least two means include the blanket cleaning means and the web continuous supplement means.

* * * * *